US005450653A

United States Patent [19]

Howie, Jr.

[11] Patent Number: 5,450,653

[45] Date of Patent: Sep. 19, 1995

[54] COMPOSITE KNOB WITH AN INSERTABLE POSITION INDICATOR

[75] Inventor: Robert K. Howie, Jr., Decatur, Ill.

[73] Assignee: The Grigoleit Company, Decatur, Ill.

[21] Appl. No.: 177,600

[22] Filed: Jan. 5, 1994

[51] Int. Cl.[6] ..... G05G 1/10

[52] U.S. Cl. ..... 16/121; 74/553; 16/DIG. 19; 16/DIG. 30

[58] Field of Search ..... 16/118, 121, DIG. 18, 16/DIG. 19, DIG. 30; 200/309, 314, 316; 74/553

[56] References Cited

U.S. PATENT DOCUMENTS

| | | | |
|---|---|---|---|
| 3,163,739 | 12/1964 | Hutt | 200/314 |
| 3,619,594 | 11/1971 | Morez | 74/553 |
| 4,000,539 | 1/1977 | Neyer | 16/121 |
| 5,050,269 | 9/1991 | Engstrom et al. | 16/118 |
| 5,303,612 | 4/1994 | Odom et al. | 16/121 |

FOREIGN PATENT DOCUMENTS

| | | | |
|---|---|---|---|
| 498960 | 8/1992 | European Pat. Off. | 74/553 |
| 2636920 | 2/1978 | Germany | 16/121 |
| 1561972 | 3/1980 | United Kingdom | 16/121 |
| 2253898 | 9/1992 | United Kingdom | 74/553 |
| 2253996 | 9/1992 | United Kingdom | 16/121 |

*Primary Examiner*—Lowell A. Larson
*Assistant Examiner*—Donald M. Gurley
*Attorney, Agent, or Firm*—Dorn, McEachran, Jambor & Keating

[57] ABSTRACT

A composite knob having a core formed of a hard plastic material and an outer covering of a softer plastic material. The core includes a front wall with an integral bent around skirt, a hub and an axially rearwardly extending stanchion. The softer plastic material covers the outer surface of the front wall and integral bent around skirt of the core. A narrow passage extends through the front wall, the bent around skirt and the outer covering and leads to the stanchion. A position indicator of contrasting color relative to the softer plastic material is inserted in the narrow passage and has a detent to engage the end of the stanchion to lock the position indicator in place with a portion thereof extending above the outer covering of the knob.

7 Claims, 1 Drawing Sheet

Fig. 1.
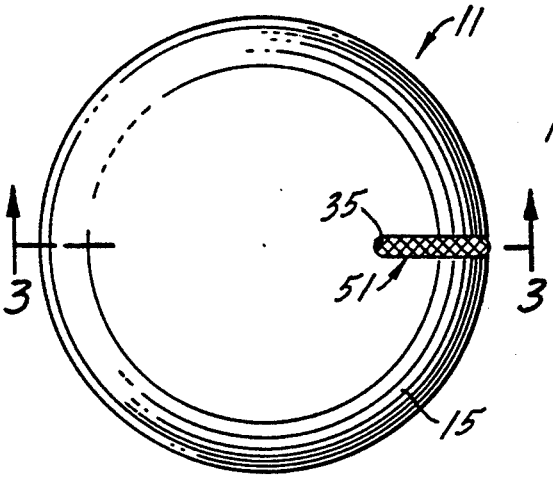
Fig. 2.
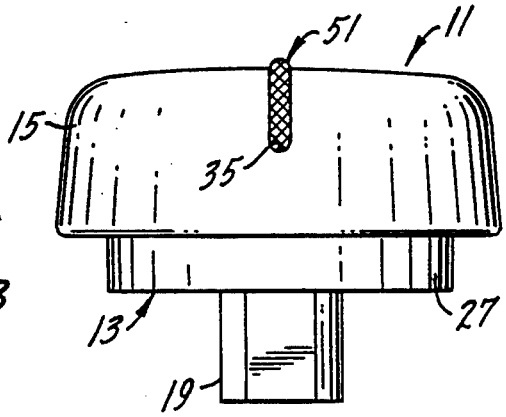
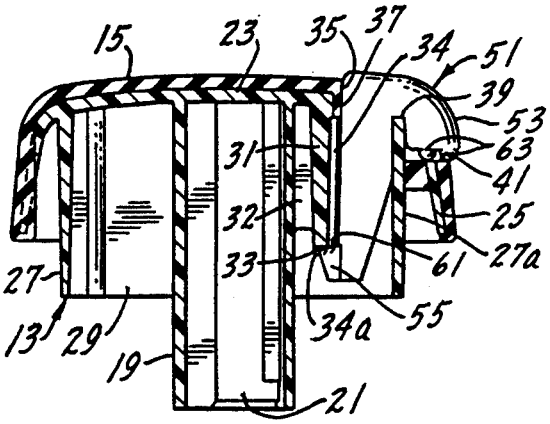
Fig. 3.
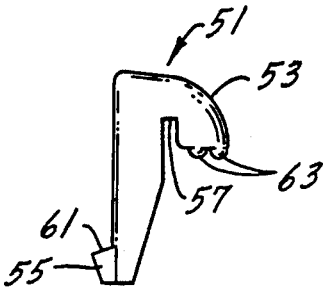
Fig. 5.
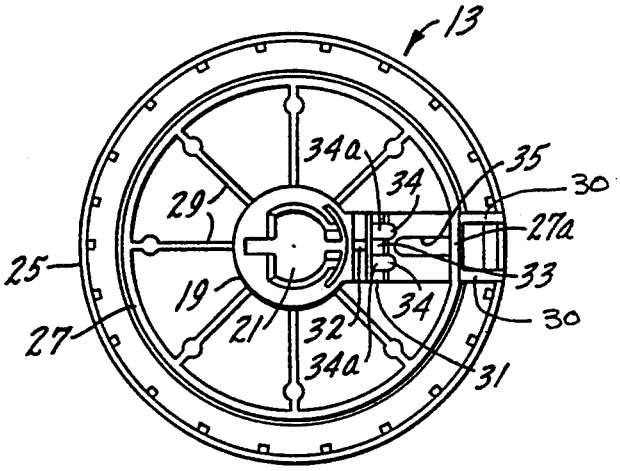
Fig. 4.

COMPOSITE KNOB WITH AN INSERTABLE POSITION INDICATOR

BACKGROUND AND SUMMARY OF THE INVENTION

This invention is directed to an alignment indicator or pointer for a composite plastic knob which indicator can be snapped into place in the knob. Composite knobs of the type having a hard, resilient core and an outer covering that is soft to the user's touch are usually molded in what is called a "two-shot" molding process. An indicator having the necessary tactile and visual differentiation from the material of the outer covering could theoretically be molded as part of the outer covering but such an integrally formed pointer would, by necessity, be of the same color and same material as the outer coating. Therefore, to visually distinguish the indicator from the outer covering, it would be necessary to highlight the indicator by the application of paint, ink, etc., through a separate and labor intensive process.

Therefore, an object of this invention is a snap-in indicator for a composite plastic knob which indicator provides to the user both a tactile and visual differentiation from the outer covering of the knob.

Another object of this invention is a snap-in indicator for a knob that is securely maintained in position by a detent on the indicator which engages the knob core when it is inserted into position in the knob.

Still another object of this invention is a snap-in indicator for a composite plastic knob in which the ease of insertion of and the holding power of the indicator can be adjusted by balancing the rigidity of the indicator relative to the rigidity of the knob.

Other objects may be found in the following specification, claims and drawings.

BRIEF DESCRIPTION OF THE DRAWINGS

The invention is illustrated more or less diagrammatically in the following drawings wherein:

FIG. 1 is an enlarged, front view of a composite knob made in accordance with the teachings of this invention and having a snap-in indicator;

FIG. 2 is a side elevational view of the knob of FIG. 1 rotated 90°;

FIG. 3 is a cross sectional view taken along line 3—3 of FIG. 1;

FIG. 4 is a bottom plan view of the knob of FIG. 1 with the snap-in indicator omitted.

FIG. 5 is a side elevational view of the snap-in indicator of this invention.

DESCRIPTION OF THE PREFERRED EMBODIMENT

The drawings show a composite knob 11 having a core 13 and an outer covering 15 with the core conventionally made of a hard injection molded plastic material and the outer covering made of a softer injection molded plastic with the composite knob normally molded in what is referred to as a "two-shot" process.

The core 13 of the knob includes a hub 19 having a socket 21, a front wall 23 with an outer peripheral skirt 25, an intermediate cylindrical wall 27 with webs 29 connecting the hub and the intermediate cylindrical wall. Additional webs (not shown) may connect the intermediate wall 27 to the outer peripheral skirt 25. These additional webs may align with or be offset circumferentially relative to the webs 29. A pair of non-radial webs 30 extend between the outer peripheral wall 25 and the intermediate cylindrical wall 27 at a flattened portion **27*a* of the wall 27 as shown in FIG. 4. The portion 27*a* of the intermediate cylindrical wall functions as a bridge in a manner to be hereinafter described. A stanchion 31 extends axially rearwardly parallel to the hub 19 and is located between the hub and the intermediate cylindrical wall 27. A web 32 extends between the stanchion and the hub 19 to stiffen the stanchion against deflection. The amount of deflection of the stanchion can be varied by varying the axial length of the web or by providing webs at opposite sides of the stanchion which, in effect, would box in the stanchion. The stanchion terminates at a bottom edge 33 which is located axially inwardly of the rearward end of the intermediate cylindrical wall. A pair of axially extending ribs 34 are formed on the outwardly facing side of the stanchion 31 to form a guide or track. The ribs continue around the end of the stanchion at 34*a* as shown in FIGS. 3 and 4**.

One or more core inserts, not shown, are positioned in the mold during the "two shots" which create the composite knob 11. The outer covering 15 formed by the "second shot" adheres to the front wall 23 and outer peripheral skirt 25 of the core 13. A narrow radially extending passage 35 is formed through the outer covering 15, the front wall 23 and the skirt 25 by the core inserts to open into the space between the stanchion 31 and the intermediate cylindrical wall 27 of the core 13. The core inserts direct the molten material of the outer covering to form a wall 37 of the soft outer material at the radial inwardly end of the passage 35. Seats 39 and 41 are formed respectively by the core inserts on the intermediate cylindrical wall 27, the skirt 25 and its outer covering 15.

The position indicator 51 is formed of a flat thin piece of plastic of irregular shape having an arcuate portion 53 at one end, a detent 55 at the opposite end and a notch 57 located between the ends thereof. The detent has an inclined surface 61. Hemispherical seat engaging protrusions 63 are formed at the lower end of the arcuate portion 53. The two hemispherical protrusions 63 are provided to seat the end of the arcuate portion 53 on the seats 41 because they are easier to form in a mold than is the shape required to form an edge at the bottom end of arcuate portion 53 which would have a convex bottom surface and a convex radial outer end.

The indicator 51 is separately molded of a hard plastic material preferably having a color contrasting with the color of the material of the outer covering 15 of the composite knob. When the indicator 51 is inserted through the narrow passage 35 its detent 55 engages the stanchion 31 between the ribs 34 bending it slightly so that when the indicator is fully inserted into the narrow passage 35, the inclined end 61 of the detent snaps under the bottom edge 33 of the stanchion 31. The ribs **34*a* on the end of the stanchion engage the detent to prevent side to side or rocking motion of the indicator after it has been snapped into place. At the same time, the notch 57 of the indicator is seated on the top surface 39 of a portion of the inner cylindrical wall 27 which functions as a bridge with the protrusions 63 engaging the surfaces 41 formed on the peripheral skirt 25 of the inner core and the outer covering 15. Thus, the indicator 51 is supported and locked in position with its arcuate portion 53 extending slightly above the outer covering 15 of the knob to provide both a tactile and visible position indicator for the knob. The wall 37 of soft outer covering 15 allows cushioning deflection of the indicator 51 as it is installed in the narrow passage 35**.

If desired all of the intermediate cylindrical wall 27, except the flattened portion 27*a* located between the webs 30, may be omitted. The remaining portion 27*a* will function as a bridge between the webs 30 to provide the seat 39 for the indicator 51.

The design of the composite knob 11 and the indicator 51 permits the balancing of the rigidity of the snap-in indicator relative to the rigidity of the knob. To vary the holding power of the snap-in indicator, the rigidity of the stanchion 31 can be changed by varying the length of its web 32. The rigidity of the indicator can be varied by removing interior portions of its body or by varying the width of its body.

I claim:

1. A composite knob including:

a core of a plastic material, preferably a hard material, an outer coating, preferably of a softer plastic material, overlying portions of said core of hard material, said core including a front wall, a hub connected to said front wall and having a longitudinal axis extending perpendicular to said front wall, a bridge and a stanchion extending parallel to said longitudinal axis and spaced radially outwardly of said hub, said stanchion terminating at a longitudinally rearward end, a narrow passage formed in said front wall of said core and said outer covering, said narrow passage defining an opening into said core located radially outwardly of said stanchion, a position indicator formed of a flat, thin elongated piece of plastic, said position indicator having a front end, a detent at the opposite end and a longitudinally extending notch located inbetween said ends, said position indicator being inserted into said narrow passage of said core with said detent engaging the end of said stanchion and said notch resting on said bridge so as to position said front end of said indicator adjacent said outer covering.

2. The composite knob of claim 1 in which said position indicator is molded of a material of a different color than said material of the outer covering.

3. The composite knob of claim 1 in which said core includes a peripheral skirt and said front end of said position indicator has a lower portion which engages a seat formed on said peripheral skirt and at least one hemispheral protrusion formed on said lower portion which engages said seat.

4. The composite knob of claim 1 in which ribs are formed on said stanchion to engage said detent to hold said position indicator against lateral movement when the position indicator is snapped into position.

5. The composite knob of claim 1 in which said front end of said position indicator protrudes relative to said outer covering.

6. A knob, including:

a core of plastic, said core having a front wall, a hub connected to said front wall and having a longitudinal axis extending perpendicular to said front wall, a bent-around peripheral skirt formed as an integral portion of said front wall, a bridge and an axially rearwardly facing ledge positioned radially outwardly of said hub, a narrow passage formed in said front wall of said core and extending into said bent-around peripheral skirt, said narrow passage defining an opening into said core radially outwardly of said ledge, a position indicator formed of a flat, thin elongated piece of plastic, said position indicator having an arcuate portion at one end, a detent at the opposite end and a longitudinally extending notch located between said ends, said position indicator being inserted into said narrow passage of said core with said detent engaging said ledge and said longitudinally extending notch resting on said bridge so as to position said arcuate portion of said indicator adjacent said front wall and said bent-around peripheral skirt.

7. The knob of claim 6 in which said arcuate portion of said position indicator protrudes relative to said front wall.

* * * * *